US011071334B1

(12) United States Patent
Pan et al.

(10) Patent No.: US 11,071,334 B1
(45) Date of Patent: Jul. 27, 2021

(54) THREE-IN-ONE HEATED WATERPROOF PANTS FOR MULTI-SEASON USE

(71) Applicant: Shandong Hua Qing Technology Ltd., Co, Jinan (CN)

(72) Inventors: Zhenguo Pan, Ningyang (CN); Chuangchuang Jiao, Gaoqing (CN)

( * ) Notice: Subject to any disclaimer, the term of this patent is extended or adjusted under 35 U.S.C. 154(b) by 0 days.

(21) Appl. No.: 17/207,833

(22) Filed: Mar. 22, 2021

(51) Int. Cl.

| | |
|---|---|
| ***A41D 13/012*** | (2006.01) |
| ***A41D 27/04*** | (2006.01) |
| ***A41D 31/102*** | (2019.01) |
| ***A41D 13/02*** | (2006.01) |
| ***A41D 13/00*** | (2006.01) |
| ***A41D 13/005*** | (2006.01) |
| ***A41D 1/00*** | (2018.01) |

(52) U.S. Cl.
CPC ..... *A41D 13/012* (2013.01); *A41D 1/005* (2013.01); *A41D 13/0012* (2013.01); *A41D 13/0051* (2013.01); *A41D 13/02* (2013.01); *A41D 27/04* (2013.01); *A41D 31/102* (2019.02); *A41D 2600/106* (2013.01)

(58) Field of Classification Search
CPC ..... A41D 27/04; A41D 31/102; A41D 13/02; A41D 13/0051; A41D 2600/106; A41D 13/012; A41D 13/0012; A41D 1/005; A41D 1/002; A41D 1/06; A41D 1/08; A41D 3/00; A41D 3/06; A41D 27/02
See application file for complete search history.

(56) References Cited

U.S. PATENT DOCUMENTS

| | | | | |
|---|---|---|---|---|
| 5,032,705 | A * | 7/1991 | Batcheller | A41D 13/0051 219/211 |
| 5,777,296 | A * | 7/1998 | Bell | A41D 13/0051 219/211 |
| 6,317,893 | B1 * | 11/2001 | Walton | A41D 13/012 2/227 |
| 6,772,440 | B1 * | 8/2004 | Foster | A41D 13/012 2/82 |
| 2013/0205465 | A1 * | 8/2013 | McClintock | A41D 31/102 2/82 |
| 2019/0069346 | A1 * | 2/2019 | Reta | H05B 3/34 |
| 2019/0281903 | A1 * | 9/2019 | Amarasiriwardena | A43B 7/04 |
| 2020/0121000 | A1 * | 4/2020 | Wood | A41D 13/02 |
| 2020/0281283 | A1 * | 9/2020 | Bell | A41D 31/065 |

* cited by examiner

*Primary Examiner* — Amy Vanatta
(74) *Attorney, Agent, or Firm* — Rumit Ranjit Kanakia

(57) ABSTRACT

A heating wearable article for being worn by a user is provided. The heating wearable article includes a waterproof and breathable body suit, a pair of waterproof boots and a liner member. The waterproof and breathable body suit include a chest portion, a pair of pants portions and a pair of adjustable shoulder straps. The pants portions are coupled to and extend downwardly from the chest portion. The pair of adjustable shoulder straps are coupled to the chest portion. The chest portion includes a front chest pocket arrangement, which includes a hand warming compartment and a storage compartment. The waterproof boots are coupled to the pants portions. The liner member is detachably coupled to a portion of an inner surface along the pair of pants portions. The liner member may include at least one heating sheet and a power source to heat the waterproof and breathable body suit.

20 Claims, 5 Drawing Sheets

THREE-IN-ONE HEATED WATERPROOF PANTS FOR MULTI-SEASON USE

FIELD OF THE DISCLOSURE

The present disclosure relates to a clothing industry, and, more particularly, to a multipurpose wearable article, including waterproof and heating abilities.

BACKGROUND OF THE DISCLOSURE

When working in fishing ponds and sewers, in order to prevent water, moisture and pollution, workers need to wear diving pants, this kind of water protection pants are generally made of waterproof boots and waterproof pants. Ordinary pants are made of rubber material.

Further, when it is cold, the rubber material of the water pants does not have the function of heat preservation. In such weather, workers generally wear thicker cotton socks and trousers, but even so, after working in the water for a long time, still feel very cold. At present, the water pants on the market may not good enough to keep warm, as most of them are very heavy and bloated, which makes working very tough for the labors as this greatly increases the workload and labor intensity of workers.

Further, conventional waterproof boots, waterproof pants, thicker cotton socks and trousers may add additional burden on the labor's body and effect there work and time.

Accordingly, there exists a need to overcome shortcomings of such existing wearable articles that precludes the problems of inconvenience and poor warmth preservation effect. There also exists a need of such an articulated wearable article that may be easy to wear and also be resistant to water and cold.

SUMMARY OF THE DISCLOSURE

In view of the foregoing disadvantages inherent in the prior art, the general purpose of the present disclosure is to provide a heating wearable article, to include all advantages of the prior art, and to overcome the drawbacks inherent in the prior art.

An object of the present disclosure is to provide a multipurpose wearable article which may precludes the problems of inconvenience and poor warmth preservation effect.

An object of the present disclosure is to provide an articulated wearable article that may be easy to wear and also be resistant to water and cold.

An object of the present disclosure is to provide a wearable article that may include various compartments with heating features to heat hands or other body parts, and such compartments that be used to store various articles.

In light of the above objects, in one aspect of the present disclosure, a heating wearable article for being worn by a user is provided. The heating wearable article may include a waterproof and breathable body suit, a pair of waterproof boots and a liner member. The waterproof and breathable body suit may include a chest portion, a pair of pants portions and a pair of adjustable shoulder straps. The pair of pants portions may be coupled to and extend downwardly from the chest portion. The pair of adjustable shoulder straps may also be coupled to the chest portion. The chest portion may include a front chest pocket arrangement. The front chest pocket arrangement may include a hand warming compartment and a storage compartment disposed over the hand warming compartment. The pair of waterproof boots may be coupled to the pair of pants portions. The waterproof and breathable body suit defines an inner surface extending from the chest portion to the pair of pants portions. The liner member may be detachably coupled to a portion of the inner surface along the pair of pants portions. The liner member may include at least one heating sheet and a power source. The at least one heating sheet may be coupled to the liner member. The power source may be electrically coupled to the at least one heating sheet to power the at least one heating sheet to generate the heat.

In one embodiment, the front chest pocket arrangement may further include a separating layer, a connecting layer and a sealing layer. The separating layer may be coupled to the chest portion to form the hand warming compartment and separate the storage compartment from the hand warming compartment. The separating layer may include a top half and a bottom half. The connecting layer may be disposed over the top half of the separating layer and coupled to a portion of the chest portion. Further, the sealing layer may be disposed over the bottom half of the separating layer and coupled to a portion of the chest portion. The separating layer, the connecting layer and the sealing layer collectively defines the storage compartment formed over the hand warming compartment.

In one embodiment, each adjustable strap of the pair of adjustable shoulder straps may include an engaging strap and a plurality of buckle portions. The engaging strap may be coupled to each adjustable strap of the pair of adjustable shoulder straps. Further, the plurality of buckle portions may be coupled to each adjustable strap of the pair of adjustable shoulder straps to detachably attached with engaging strap to adjust the pair of adjustable shoulder straps. In one example form, the pair of adjustable shoulder straps may be of elastic.

In one embodiment, the liner member may further include an electrical circuitry arrangement, a switch member and at least one charging port. The electrical circuitry arrangement may electrically be coupled to the at least one heating sheet and the power source. The switch member may electrically be coupled to the electrical circuitry arrangement to active the at least one heating sheet upon coupling the electrical circuitry arrangement with the power source. The at least one charging port adapted to charge the power source. In one example form, the at least one charging port may be one of a USB port or DC port.

In one embodiment, the inner liner may include a plurality of detachable layers and that the heating sheet may be disposed in between the plurality of layers. In one example form, the heating sheet may be of carbon fiber or composite fiber.

In one embodiment, the inner liner and the pair of pants portions may collectively include a waist loop member to tighten the inner liner and the pair of pants portions.

In one embodiment, the inner liner may include a waist loop member, such as the waist loop member, in itself to tighten the inner liner.

In one embodiment, the pair of waterproof boots may be fixedly coupled to the pair of pants portions via glue or stitch. In one embodiment, the pair of waterproof boots may be detachably coupled to the pair of pants portions.

In one another aspect of the present disclosure, a heating wearable article for being worn by a user is provided. The heating wearable article may include a waterproof and breathable body suit, a pair of waterproof boots and a liner member. The waterproof and breathable body suit may include a chest portion, a pair of pants portions and a pair of adjustable shoulder straps. The pair of pants portions may be coupled to and extend downwardly from the chest portion. The pair of adjustable shoulder straps may also be coupled to the chest portion. The chest portion may include a front chest pocket arrangement. The front chest pocket arrangement may include a hand warming compartment and a storage compartment disposed over the hand warming compartment. The front chest pocket arrangement may further include a separating layer, a connecting layer and a sealing layer. The separating layer may be coupled to the chest portion to form the hand warming compartment and separate the storage compartment from the hand warming compartment. The separating layer may include a top half and a bottom half. The connecting layer may be disposed over the top half of the separating layer and coupled to a portion of the chest portion. Further, the sealing layer may be disposed over the bottom half of the separating layer and coupled to a portion of the chest portion. The separating layer, the connecting layer and the sealing layer collectively defines the storage compartment formed over the hand warming compartment. The pair of waterproof boots may be coupled to the pair of pants portions. The waterproof and breathable body suit defines an inner surface extending from the chest portion to the pair of pants portions. The liner member may be detachably coupled to a portion of the inner surface along the pair of pants portions. The liner member may include at least one heating sheet and a power source. The at least one heating sheet may be coupled to the liner member. The power source may be electrically coupled to the at least one heating sheet to power the at least one heating sheet to generate the heat.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description taken in conjunction with the accompanying drawing, in which.

DETAILED DESCRIPTION OF THE DISCLOSURE

Figure 1:
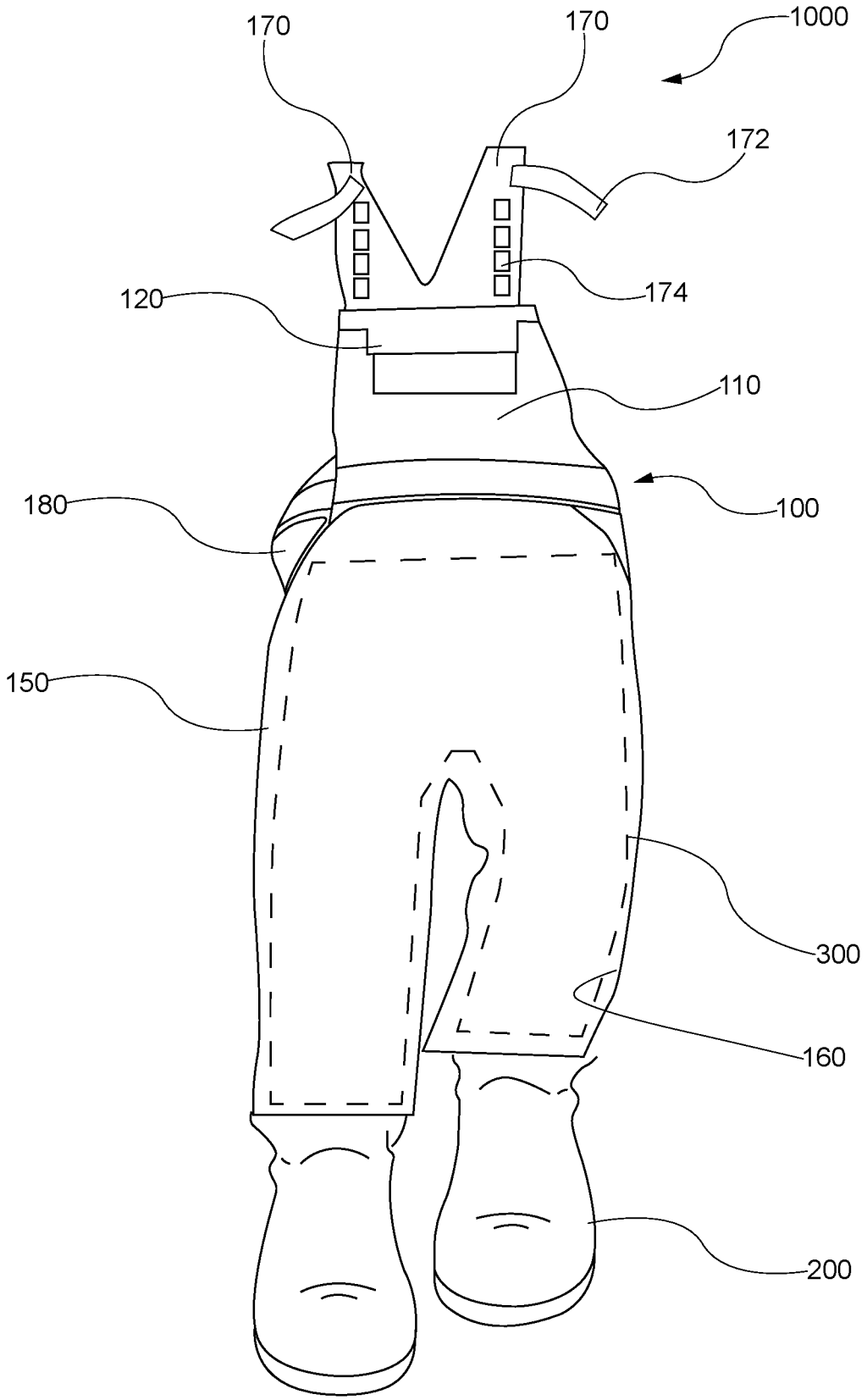
FIG. 1 illustrates a front perspective view of a heating wearable article, in accordance with an exemplary embodiment of the present disclosure.

The exemplary embodiments described herein detail for illustrative purposes are subject to many variations in implementation. The present disclosure provides a heating wearable article. It should be emphasized, however, that the present disclosure is not limited only to what is disclosed and extends to cover various alternation to the heating wearable article. It is understood that various omissions and substitutions of equivalents are contemplated as circumstances may suggest or render expedient, but these are intended to cover the application or implementation without departing from the spirit or scope of the present disclosure.

The terms "a" and "an" herein do not denote a limitation of quantity, but rather denote the presence of at least one of the referenced items.

The terms "having", "comprising", "including", and variations thereof signify the presence of a component.

In one aspect of the present disclosure, a heating wearable article for being worn by a user is provided. The heating wearable article may include a waterproof and breathable body suit, a pair of waterproof boots and a liner member. The waterproof and breathable body suit may include a chest portion, a pair of pants portions and a pair of adjustable shoulder straps. The pair of pants portions may be coupled to and extend downwardly from the chest portion. The pair of adjustable shoulder straps may also be coupled to the chest portion. The chest portion may include a front chest pocket arrangement. The front chest pocket arrangement may include a hand warming compartment and a storage compartment disposed over the hand warming compartment. The pair of waterproof boots may be coupled to the pair of pants portions. The waterproof and breathable body suit defines an inner surface extending from the chest portion to the pair of pants portions. The liner member may be detachably coupled to a portion of the inner surface along the pair of pants portions. The liner member may include at least one heating sheet and a power source. The at least one heating sheet may be coupled to the liner member. The power source may be electrically coupled to the at least one heating sheet to power the at least one heating sheet to generate the heat.

In one another aspect of the present disclosure, a heating wearable article for being worn by a user is provided. The heating wearable article may include a waterproof and breathable body suit, a pair of waterproof boots and a liner member. The waterproof and breathable body suit may include a chest portion, a pair of pants portions and a pair of adjustable shoulder straps. The pair of pants portions may be coupled to and extend downwardly from the chest portion. The pair of adjustable shoulder straps may also be coupled to the chest portion. The chest portion may include a front chest pocket arrangement. The front chest pocket arrangement may include a hand warming compartment and a storage compartment disposed over the hand warming compartment. The front chest pocket arrangement may further include a separating layer, a connecting layer and a sealing layer. The separating layer may be coupled to the chest portion to form the hand warming compartment and separate the storage compartment from the hand warming compartment. The separating layer may include a top half and a bottom half. The connecting layer may be disposed over the top half of the separating layer and coupled to a portion of the chest portion. Further, the sealing layer may be disposed over the bottom half of the separating layer and coupled to a portion of the chest portion. The separating layer, the connecting layer and the sealing layer collectively defines the storage compartment formed over the hand warming compartment. The pair of waterproof boots may be coupled to the pair of pants portions. The waterproof and breathable body suit defines an inner surface extending from the chest portion to the pair of pants portions. The liner member may be detachably coupled to a portion of the inner surface along the pair of pants portions. The liner member may include at least one heating sheet and a power source. The at least one heating sheet may be coupled to the liner member. The power source may be electrically coupled to the at least one heating sheet to power the at least one heating sheet to generate the heat.

A heating wearable article 1000 will now be described in conjunction with FIGS. 1 to 5B, in accordance with an exemplary embodiment of the present disclosure.

Figure 2A:
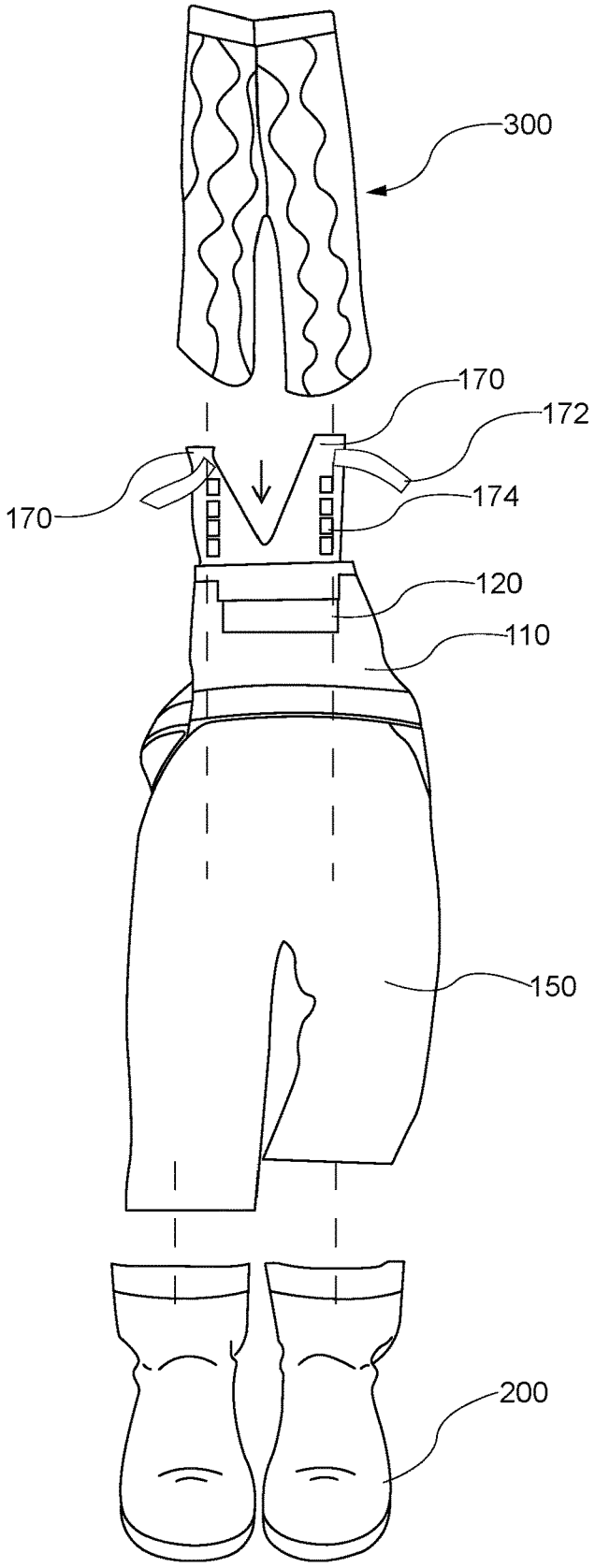
FIG. 2A illustrates an exploded perspective front view of a heating wearable article, in accordance with an exemplary embodiment of the present disclosure.
Figure 2B:
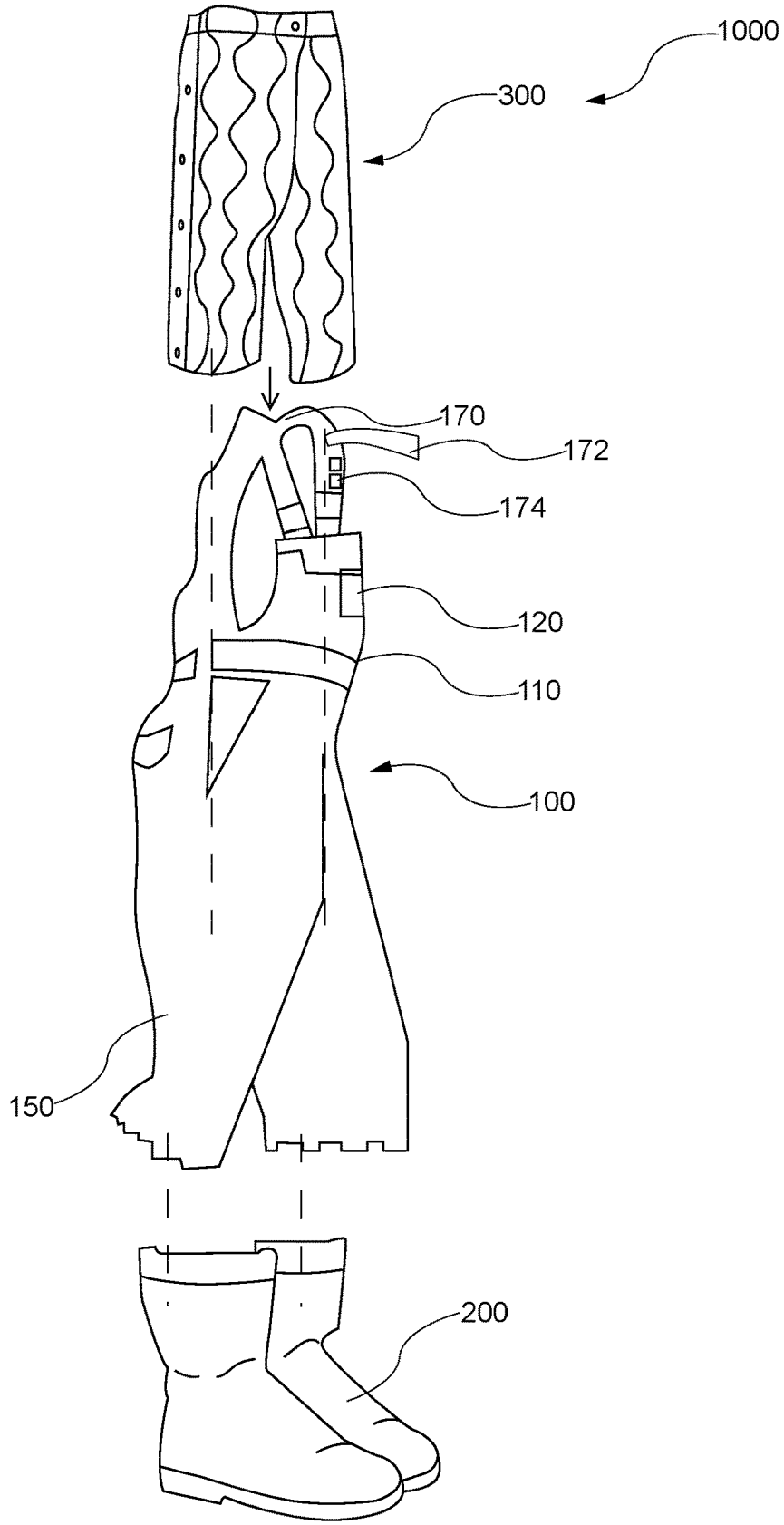
FIG. 2B illustrates an exploded perspective side view of a heating wearable article, in accordance with an exemplary embodiment of the present disclosure.

As shown in FIGS. 1, 2A and 2B, the heating wearable article 1000 for being worn by a user is provided. The heating wearable article 1000 may include a waterproof and breathable body suit 100, a pair of waterproof boots 200 and a liner member 300. The liner member 300 may be disposed in the waterproof and breathable body suit 100. Further, the pair of waterproof boots 200 may be coupled to the pair of pants portions 150. In one embodiment, as shown in FIGS. 1, 2A and 2B, the pair of waterproof boots 200 may be fixedly coupled to the pair of pants portions 150 via glue or stitch. In one another embodiment, the pair of waterproof boots 200 may be detachably coupled to the pair of pants portions 150.

The waterproof and breathable body suit 100 may include a chest portion 110, a pair of pants portions 150 and a pair of adjustable shoulder straps 170. The pair of pants portions 150 may be coupled to and extend downwardly from the chest portion 110. The pair of adjustable shoulder straps 170 may also be coupled to the chest portion 110. In one example arrangement, the pair of adjustable shoulder straps 170, the pair of pants portions 150 and the chest portion 110 may be stitched or glued to obtain the waterproof and breathable body suit 100. In one another example arrangement, the pair of adjustable shoulder straps 170, the pair of pants portions 150 and the chest portion 110 may be formed as one piece obtain the waterproof and breathable body suit 100.

Figure 3:
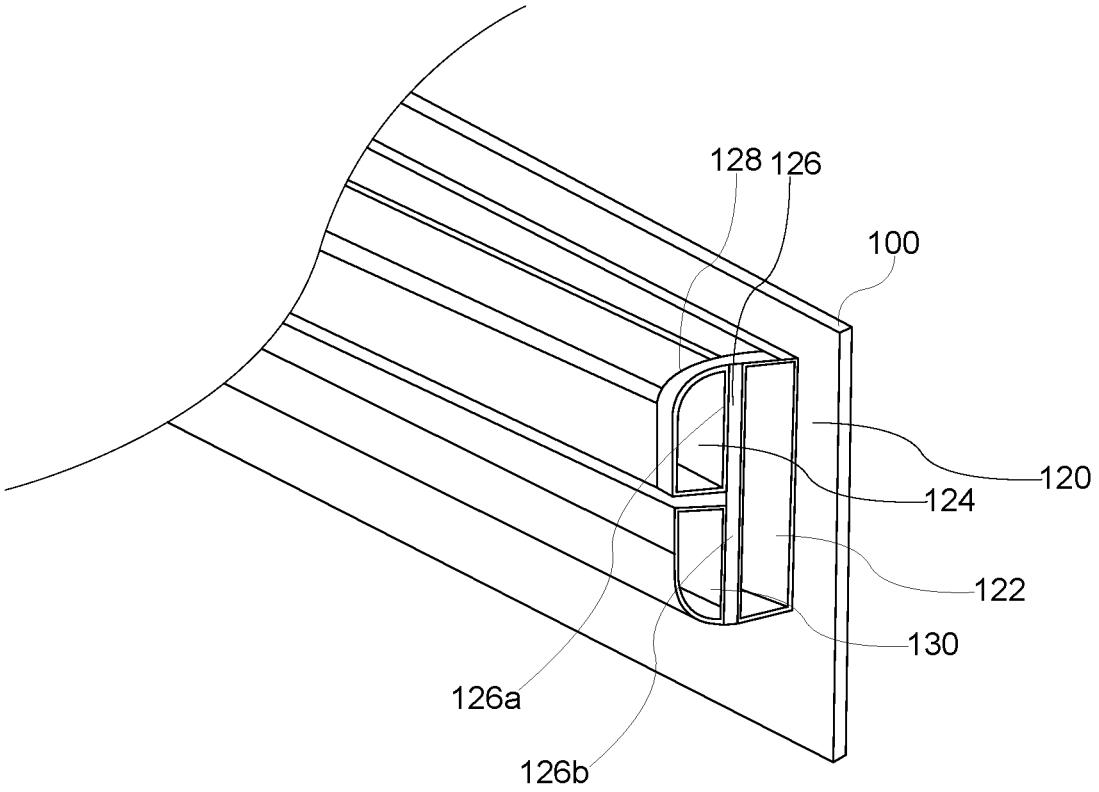
FIG. 3 illustrates a perspective view of a front chest pocket arrangement of a heating wearable article, in accordance with an exemplary embodiment of the present disclosure.

As shown in FIG. 3, and will be described in conjunction with FIGS. 1 to 2B, the chest portion 110 may include a front chest pocket arrangement 120. The front chest pocket arrangement 120 may include a hand warming compartment 122 and a storage compartment 124 disposed over the hand warming compartment 122. The hand warming compartment 122 and the storage compartment 124 may include respective openings for the accessibility of respective compartments 122, 124. The openings may be along the side portions or along the top portions of the respective compartments 122, 124.

In one embodiment, as also shown in FIG. 3, the front chest pocket arrangement 120 may further include a separating layer 126, a connecting layer 128 and a sealing layer 130. The separating layer 126 may be coupled to the chest portion 110 to form the hand warming compartment 122 and separate the storage compartment 124 from the hand warming compartment 122. The separating layer 126 may include a top half 126*a* and a bottom half 126*b*. The connecting layer 128 may be disposed over the top half 126*a* of the separating layer 126 and coupled to a portion of the chest portion 110. Further, the sealing layer 130 may be disposed over the bottom half 126*b* of the separating layer 126 and coupled to a portion of the chest portion 110. The separating layer 126, the connecting layer 128 and the sealing layer 130 collectively defines the storage compartment 124 formed over the hand warming compartment 122.

Figure 4:
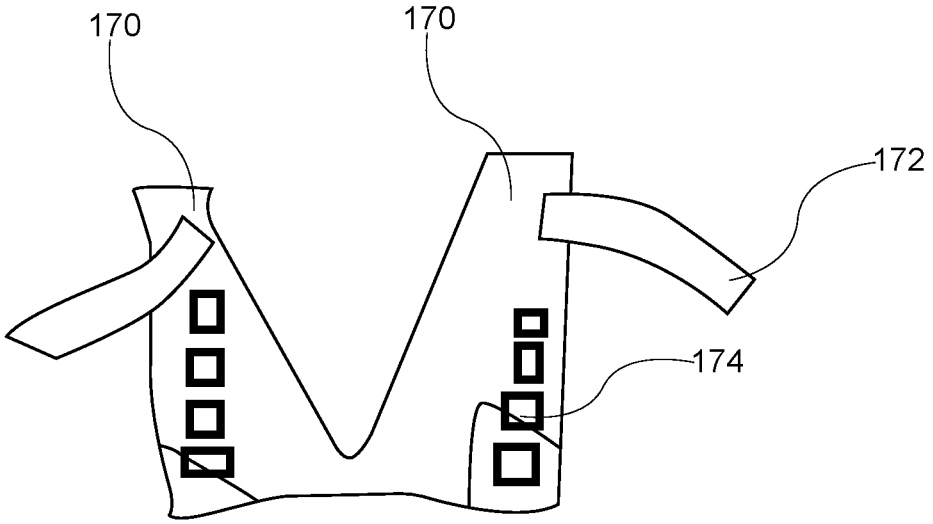
FIG. 4 illustrates an enlarged view of an adjustable shoulder strap of the heating wearable article, in accordance with an exemplary embodiment of the present disclosure.

Referring now to FIG. 4 and will be described in conjunction with FIGS. 1 to 2B, in one embodiment, each adjustable strap of the pair of adjustable shoulder straps 170 may include an engaging strap 172 and a plurality of buckle portions 174. The engaging strap 172 may be coupled to each adjustable strap 170 of the pair of adjustable shoulder straps 170. Further, the plurality of buckle portions 174 may be coupled to each adjustable strap 170 of the pair of adjustable shoulder straps 170 to detachably attached with engaging strap 172 to adjust the pair of adjustable shoulder straps 170. In one example form, the pair of adjustable shoulder straps 170 may be of elastic material. However, without departing from the scope of the present disclosure, the pair of adjustable shoulder straps 170 may be of non-elastic material.

Figure 5A:
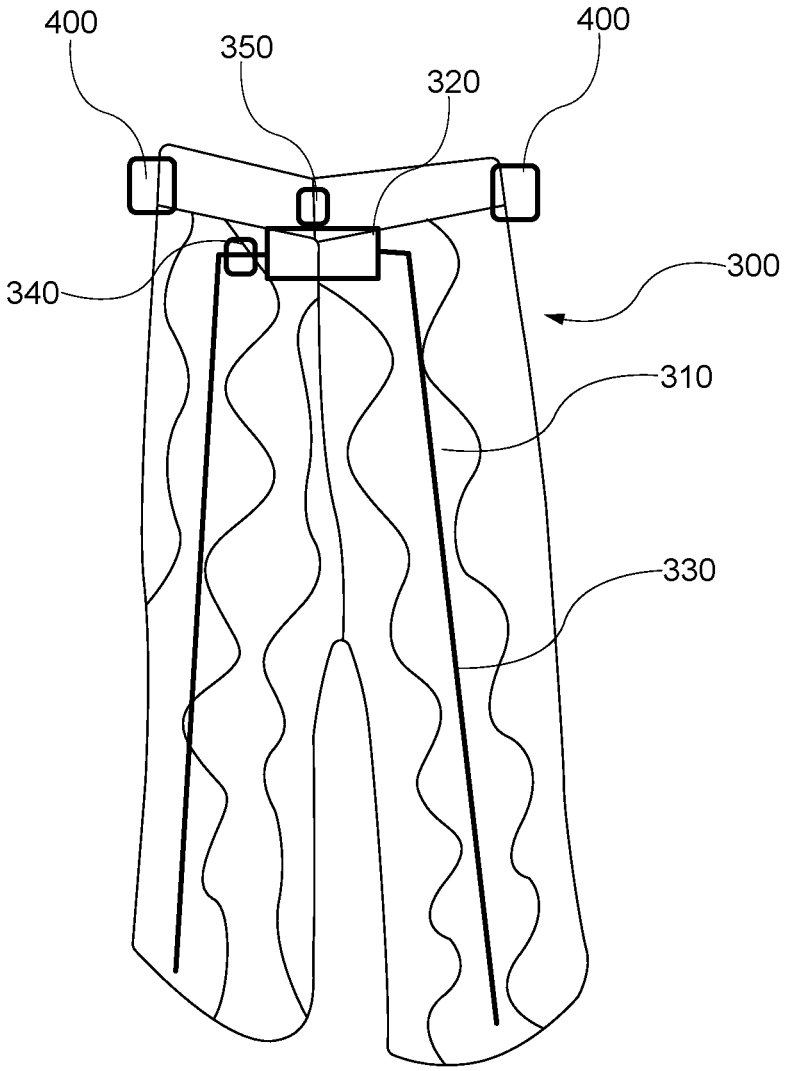
FIG. 5A illustrates a liner of heating wearable article, in accordance with an exemplary embodiment of the present disclosure.
Figure 5B:
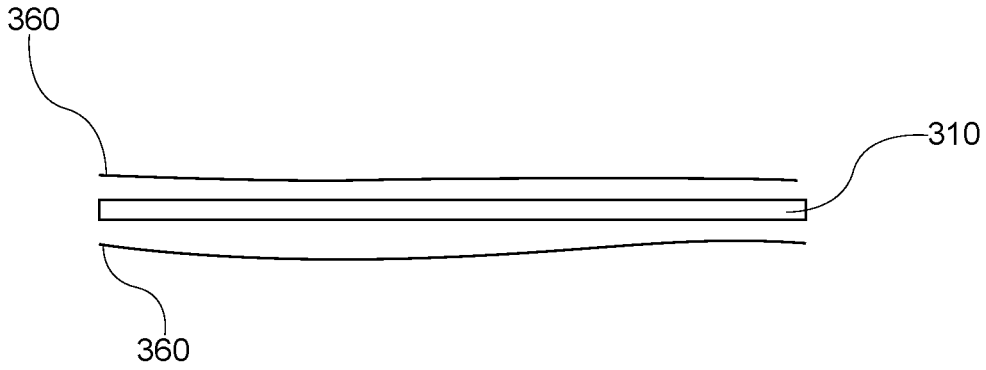
FIG. 5B illustrates various layers of a liner incorporating a heating sheet, in accordance with an exemplary embodiment of the present disclosure; and Like reference numerals refer to like parts throughout the description of several views of the drawing.

Referring now to FIGS. 5A and 5B and will be described in conjunction with FIGS. 1 to 2B, in one embodiment, the waterproof and breathable body suit 100 may define an inner surface 160 (as shown in FIG. 1) extending from the chest portion 110 to the pair of pants portions 150. The liner member 300 may be detachably coupled to a portion of the inner surface 160 along the pair of pants portions 150 of the waterproof and breathable body suit 100. The liner member 300 may include attaching arrangement such as complementary zippers or complementary Velcro or any other suitable arrangements configured on both, the liner member and the pants portions 150 to detachably coupled to a portion of the inner surface 160 along the pair of pants portions 150 of the waterproof and breathable body suit 100.

In one embodiment, as shown in FIG. 5A, the liner member 300 may include at least one heating sheet 310 and a power source 320. The at least one heating sheet 310 may be coupled to the liner member 300. The power source 320 may be electrically coupled to the at least one heating sheet 310 to power the at least one heating sheet 310 to generate the heat. The liner member 300 may further include an electrical circuitry arrangement 330, a switch member 340 and at least one charging port 350. The electrical circuitry arrangement 330 may electrically be coupled to the at least one heating sheet 310 and the power source 320. The switch member 340 may electrically be coupled to the electrical circuitry arrangement 330 to active the at least one heating sheet 310 upon coupling the electrical circuitry arrangement 330 with the power source 320. The at least one charging port 350 adapted to charge the power source 320. In one example, the power source 320 may be a battery or a rechargeable battery. In one example form, the at least one charging port 350 may be one of a USB port or DC port.

In one embodiment, as shown in FIG. 5B, the inner liner 300 may include a plurality of detachable layers 360 and that the heating sheet 310 is disposed in between the plurality of layers 360. In one example form, the heating sheet 310 may be of carbon fiber or composite fiber.

In one embodiment, as shown in FIG. 5A, the inner liner 300 may include a waist loop member 400, in itself to tighten the inner liner 300. In one another embodiment, the inner liner 300 and the pair of pants portions 150 may collectively comprises a waist loop member, such as the waist loop member 400, to tighten the inner liner 300 and the pair of pants portions 150 upon being worn by the user.

In one embodiment, as shown in FIG. 1, the waterproof and breathable body suit 100 may include side pocket arrangements 180 incorporated with a heating sheet, such as the heating sheet 310.

The present disclosure is advantageous in providing a heating wearable article which include simple structural body suit, and are lighter and more comfortable to wear. Such heating wearable article includes the waterproof and breathable body suit with inner liner that may have flexible use, reducing costing of having multiple clothes for various other purposes, such as for hunting, fishing, fishing, agriculture, various other outdoor activities and so forth. The present disclosure is advantageous in providing wearable article that may be easy to wear and also be resistant to water and cold. The present disclosure is also advantageous in providing a wearable article that may include various compartments with heating features to heat hands or other body parts, and such compai intents that be used to store various articles.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. A heating wearable article for being worn by a user, the heating wearable article comprising:

a waterproof and breathable body suit having, a chest portion having a front chest pocket arrangement, the front chest pocket arrangement having, a hand warming compartment, a storage compartment disposed over the hand warming compartment, a pair of pants portions coupled to and extending downwardly from the chest portion, an inner surface extending from the chest portion to the pair of pants portions, a pair of adjustable shoulder straps coupled to the chest portion;

a pair of waterproof boots coupled to the pair of pants portions; and a liner member detachably coupled to a portion of the inner surface of the waterproof and breathable body suit along the pair of pants portions, the liner member having at least one heating sheet coupled to the liner member, and a power source electrically coupled to the at least one heating sheet to power the at least one heating sheet to generate the heat.

2. The heating wearable article of claim 1, wherein the front chest pocket arrangement further comprises:

a separating layer coupled to the chest portion to form the hand warming compartment and separate the storage compartment from the hand warming compartment, the separating layer having a top half and a bottom half, and a connecting layer disposed over the top half of the separating layer and coupled to a portion of the chest portion, a sealing layer disposed over the bottom half of the separating layer and coupled to a portion of the chest portion, wherein the separating layer, the connecting layer and the sealing layer collectively defines the storage compartment formed over the hand warming compartment.

3. The heating wearable article of claim 1, wherein each adjustable strap of the pair of adjustable shoulder straps comprises:

an engaging strap coupled to each adjustable strap of the pair of adjustable shoulder straps;

a plurality of buckle portions coupled to each adjustable strap of the pair of adjustable shoulder straps to detachably attach with the engaging strap to adjust the pair of adjustable shoulder straps.

4. The heating wearable article of claim 1, wherein the pair of adjustable shoulder straps is of elastic.

5. The heating wearable article of claim 1, wherein the liner member further comprises:

an electrical circuitry arrangement electrically coupled to the at least one heating sheet and the power source;

a switch member electrically coupled to the electrical circuitry arrangement to activate the at least one heating sheet by coupling the electrical circuitry arrangement with the power source; and at least one charging port to charge the power source.

6. The heating wearable article of claim 5, wherein the at least one charging port is one of a USB port or DC port.

7. The heating wearable article of claim 1, wherein the liner member comprises a plurality of detachable layers, and wherein the heating sheet is disposed in between the plurality of layers.

8. The heating wearable article of claim 1, wherein the heating sheet is of carbon fiber or composite fiber.

9. The heating wearable article of claim 1, wherein the liner member and the pair of pants portions collectively comprises a waist loop member to tighten the inner liner and the pair of pants portions.

10. The heating wearable article of claim 1, wherein the liner member comprises a waist loop member to tighten the inner liner.

11. The heating wearable article of claim 1, wherein the pair of waterproof boots is fixedly coupled to the pair of pants portions.

12. The heating wearable article of claim 1, wherein the pair of waterproof boots is detachably coupled to the pair of pants portions.

13. A heating wearable article for being worn by a user, the wearable article comprising:

a waterproof and breathable body suit having, a chest portion having a front chest pocket arrangement, the front chest pocket arrangement having, a hand warming compartment, a storage compartment, a separating layer coupled to the chest portion to form the hand warming compartment and separate the storage compartment from the hand warming compartment, the separating layer having a top half and a bottom half, and a connecting layer disposed over the top half of the separating layer and coupled to a portion of the chest portion, a sealing layer disposed over the bottom half of the separating layer and coupled to a portion of the chest portion, wherein the separating layer, the connecting layer and the sealing layer collectively defines the storage compartment formed over the hand warming compartment, a pair of pants portions coupled to and extending downwardly from the chest portion, an inner surface extending from the chest portion to the pair of pants portions, a pair of adjustable shoulder straps coupled to the chest portion;

a pair of waterproof boots coupled to the pair of pants portions; and a liner member detachably coupled to a portion of the inner surface of the waterproof and breathable body suit along the pair of pants portions, the liner member having, at least one heating sheet coupled to the liner member, and a power source electrically coupled to the at least one heating sheet to power the at least one heating sheet to generate the heat.

14. The heating wearable article of claim 13, wherein each adjustable strap of the pair of adjustable shoulder straps comprises:

an engaging strap coupled to each adjustable strap of the pair of adjustable shoulder straps;

a plurality of buckle portions coupled to each adjustable strap of the pair of adjustable shoulder straps to detachably attach with the engaging strap to adjust the pair of adjustable shoulder straps.

15. The heating wearable article of claim 13, wherein the liner member further comprises:

an electrical circuitry arrangement electrically coupled to the at least one heating sheet and the power source;

a switch member electrically coupled to the electrical circuitry arrangement to activate the at least one heating sheet by coupling the electrical circuitry arrangement with the power source; and at least one charging port to charge the power source, wherein the at least one charging port is one of a USB port or DC port.

16. The heating wearable article of claim 13, wherein the liner member comprises a plurality of layers, and wherein the heating sheet is disposed in between the plurality of layers.

17. The heating wearable article of claim 13, wherein the liner member and the pair of pants portions collectively comprises a waist loop member to tighten the inner liner and the pair of pants portions.

18. The heating wearable article of claim 13, wherein the liner member comprises a waist loop member to tighten the inner liner.

19. The heating wearable article of claim 13, wherein the pair of waterproof boots is fixedly coupled to the pair of pants portions.

20. The heating wearable article of claim 13, wherein the pair of waterproof boots is detachably coupled to the pair of pants portions.

* * * * *